US009140105B2

(12) United States Patent
Pattillo

(10) Patent No.: US 9,140,105 B2
(45) Date of Patent: Sep. 22, 2015

(54) TEMPORARY SUPPORT DEVICE FOR OIL WELL TUBES AND METHOD OF USE

(76) Inventor: Lance N. Pattillo, Cypress, TX (US)

( * ) Notice: Subject to any disclaimer, the term of this patent is extended or adjusted under 35 U.S.C. 154(b) by 418 days.

(21) Appl. No.: 13/606,930

(22) Filed: Sep. 7, 2012

(65) Prior Publication Data

US 2013/0087346 A1 Apr. 11, 2013

(30) Foreign Application Priority Data

Oct. 11, 2011 (AR) ..... 20110103741

(51) Int. Cl.
*E21B 43/10* (2006.01)
*E21B 33/04* (2006.01)
*E21B 33/14* (2006.01)

(52) U.S. Cl.
CPC ..... *E21B 43/10* (2013.01); *E21B 33/0415* (2013.01); *E21B 33/14* (2013.01); *E21B 33/0422* (2013.01)

(58) Field of Classification Search
CPC ..... E21B 33/0422
USPC ..... 166/77.51, 77.53, 75.14, 382, 96.1
See application file for complete search history.

(56) References Cited

U.S. PATENT DOCUMENTS

| | | | | | |
|---|---|---|---|---|---|
| 2,690,847 | A * | 10/1954 | Crookston | 414/22.51 |
| 3,579,752 | A * | 5/1971 | Brown | 188/67 |
| 3,695,351 | A * | 10/1972 | Lubinski | 166/96.1 |
| 3,748,702 | A * | 7/1973 | Brown | 188/67 |
| 4,209,066 | A * | 6/1980 | Watson | 166/377 |
| 4,332,062 | A * | 6/1982 | Byrne, Jr. | 188/67 |
| 4,379,657 | A * | 4/1983 | Widiner et al. | 405/224.4 |
| 4,440,220 | A * | 4/1984 | McArthur | 166/85.5 |
| 4,440,536 | A * | 4/1984 | Scaggs | 414/22.51 |
| 4,476,936 | A * | 10/1984 | Boyadjieff et al. | 166/383 |
| 4,733,991 | A * | 3/1988 | Myers | 405/224.2 |
| 6,585,455 | B1 * | 7/2003 | Petersen et al. | 405/224.4 |
| 7,025,147 | B2 * | 4/2006 | Adams et al. | 166/382 |
| 7,350,587 | B2 * | 4/2008 | Springett et al. | 166/380 |
| 7,419,000 | B1 * | 9/2008 | Marsh | 166/77.51 |
| 7,484,558 | B2 * | 2/2009 | Wood | 166/96.1 |
| 8,333,243 | B2 * | 12/2012 | Pallini et al. | 166/367 |
| 2002/0166669 | A1 * | 11/2002 | Sipos et al. | 166/379 |
| 2004/0045703 | A1 * | 3/2004 | Hooper et al. | 166/77.51 |
| 2006/0225891 | A1 * | 10/2006 | Adams et al. | 166/382 |
| 2008/0105463 | A1 * | 5/2008 | Adams et al. | 175/7 |
| 2010/0212916 | A1 * | 8/2010 | Rice | 166/379 |
| 2011/0114308 | A1 * | 5/2011 | Nikiforuk et al. | 166/250.01 |
| 2012/0018164 | A1 * | 1/2012 | Tabor et al. | 166/340 |

* cited by examiner

*Primary Examiner* — Blake Michener
(74) *Attorney, Agent, or Firm* — Shawn Hunter

(57) ABSTRACT

A temporary support device for oil well tubes and method of use. The device comprises a holding structure to be applied to the well surface casing, a holding base resting in the well's cellar floor and sets of adjustable supporting arms connecting the holding structure and the supporting base.

11 Claims, 4 Drawing Sheets

TEMPORARY SUPPORT DEVICE FOR OIL WELL TUBES AND METHOD OF USE

This application claims priority under the Paris Convention to Argentinian patent application No. 20110103740 filed on Oct. 11, 2011.

BACKGROUND OF THE INVENTION

1. Field of the Invention

The invention relates to a temporary support for oil well tubes that allow supporting the surface casing while operations, such as completing cementation (concrete pouring) are carried out at the upper end, allowing immediate operation, thus saving rig time. The invention also relates to a method of use of the device.

2. Background of the Invention

During drilling of an oil or gas well, cementation of the surface casing is carried out, which permits definite immobilization thereof. Thus, the tube may support many tons of weight of blow-out preventers and tools required for drilling that are placed upon the well head.

At present, once the tube is cemented, a period of time of six hours or more is required for the setting-up of the cement around the tube halting drilling operations until the cement is dry. This is because if added weight is applied tubing head when the cement is not yet set, said tubing will sink or slip down the well bore.

SUMMARY OF THE INVENTION

One purpose of the invention is reducing operation times of an oil or gas well. Since the device of the invention allows immediate operation after placement, waiting times are reduced at least five hours. This time results from subtracting the device mounting time from the minimum time of six hours required for cement setting.

Another purpose of the device is allowing placement, on the well head, of blow-out preventers and other tools needed for drilling without having to wait for the cement to set-up and without the risk of their weight causing the casing to sink or slip into the well bore. Therefore, the device may work as a temporary support of the casing until cement is set-up and then it can be removed.

Another purpose is to support the casing in cases where the well head has as not yet been placed, which is attained by the contact of the present device and holding devices such as wedge devices (casing slips) or collar devices (casing safety collars).

Hydraulic positional regulation is necessary since the distances between cellar floors and well head, wedge device or collar device landing point is unknown and/or variable, whichever may be the case.

Positional fixing arms act as a mechanical safety latch supporting the weight if hydraulic means fail.

At present, several detachable or disposable means are known having a fixed structure, thus lacking means regulation or adjustability.

BRIEF DESCRIPTION OF THE DRAWINGS

For detailed understanding of the invention, reference is made to the following description of the preferred embodiments, The descriptions and drawings are solely for illustrative means are not limiting of possible variants.

Figure 1:
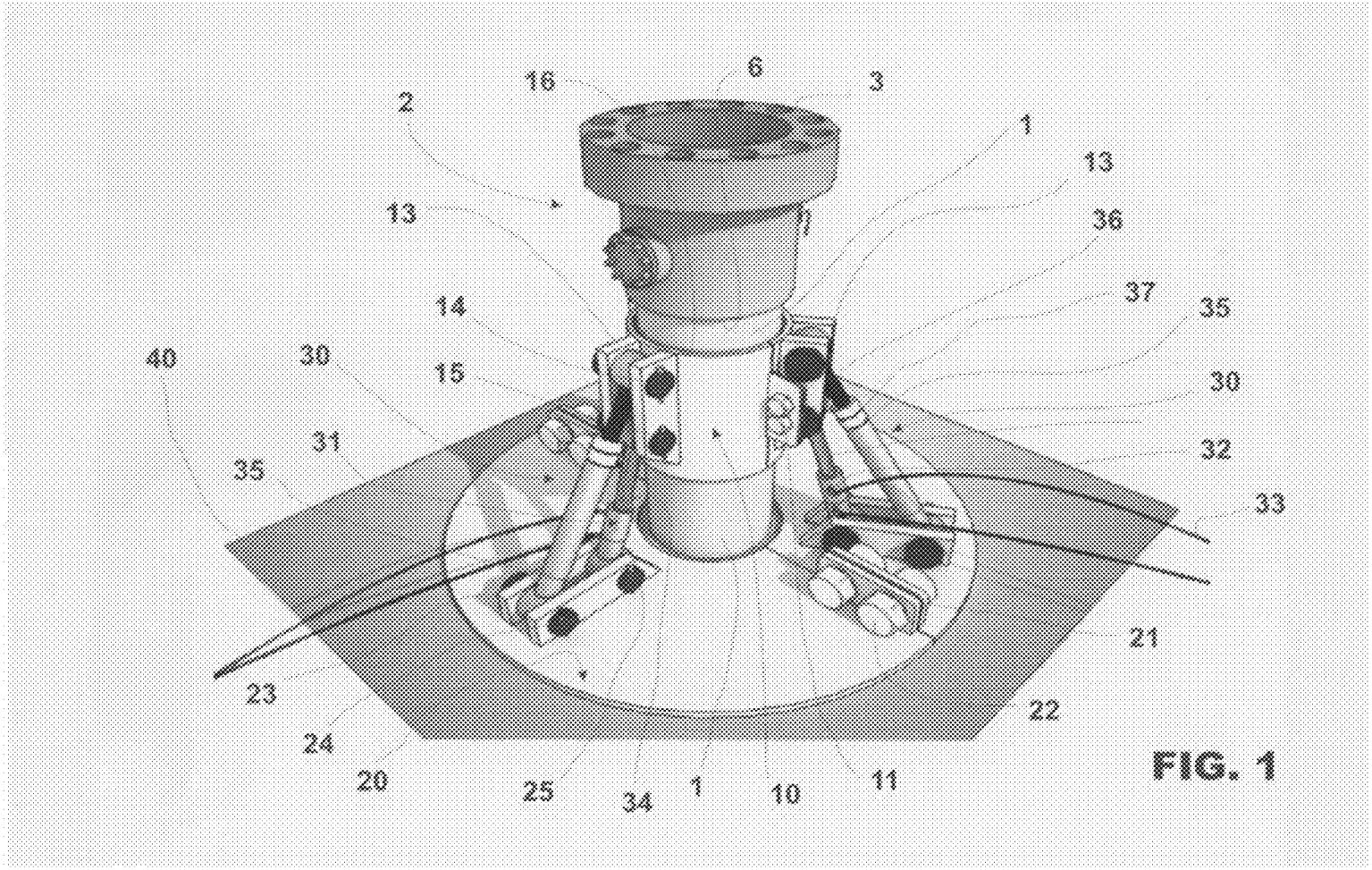
FIG. 1 is a perspective view of the device of the invention applied to the upper end of a well tube, below the well head.
Figure 2:
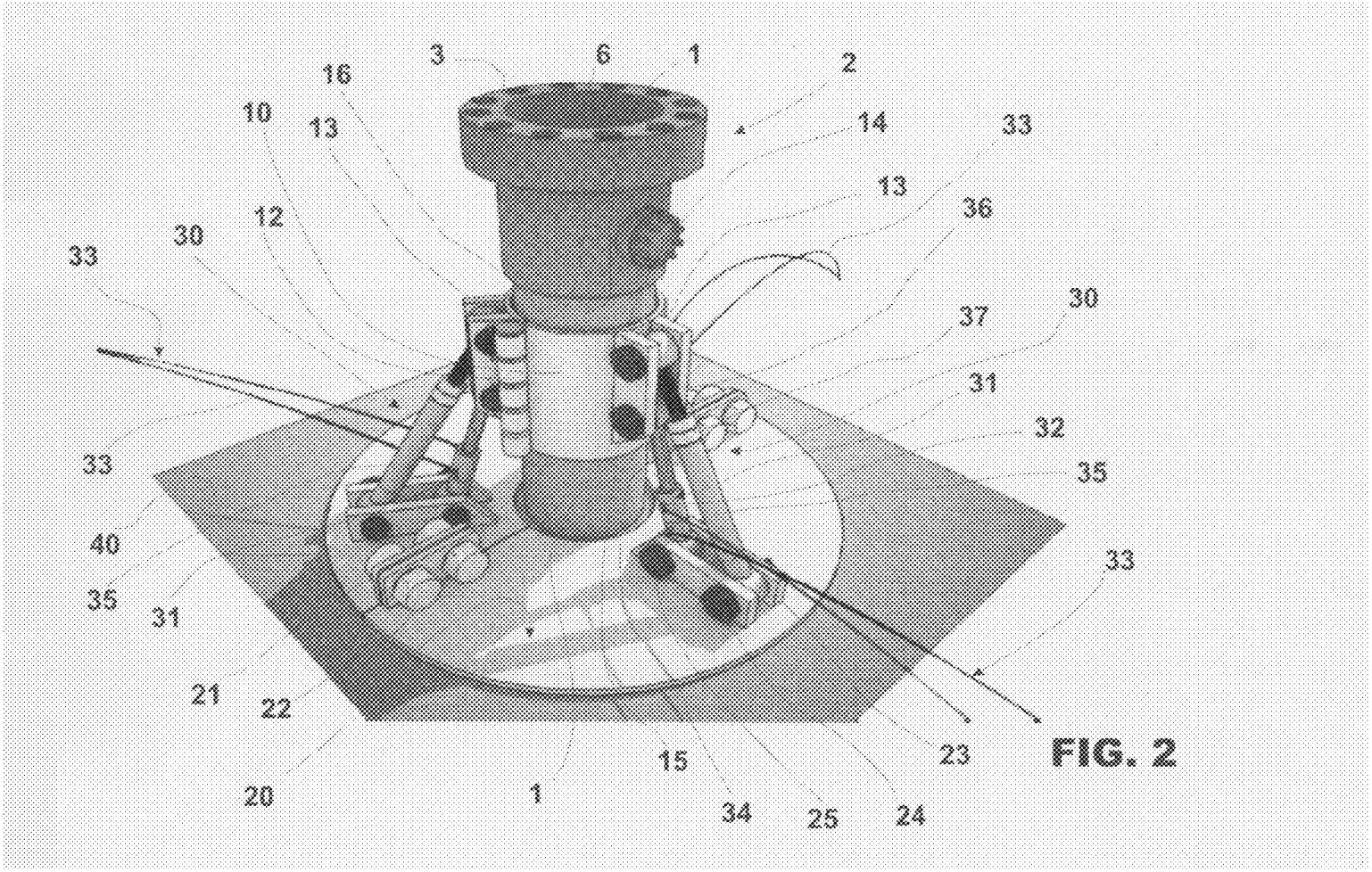
FIG. 2 is a further perspective view showing the device of the invention from another point of view.
Figure 3:
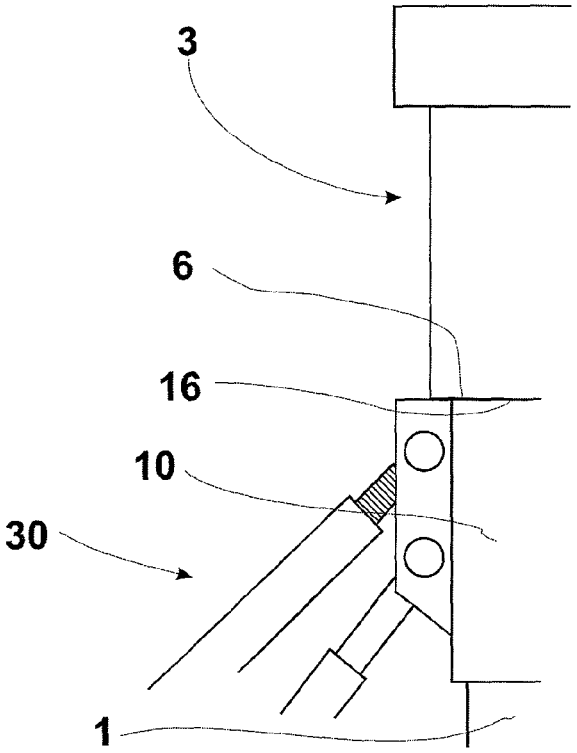
FIG. 3 is a partial side elevation view of the device of the invention with the holding structure attached around the casing and lifted to the position contacting the lower part of the well head.
Figure 4:
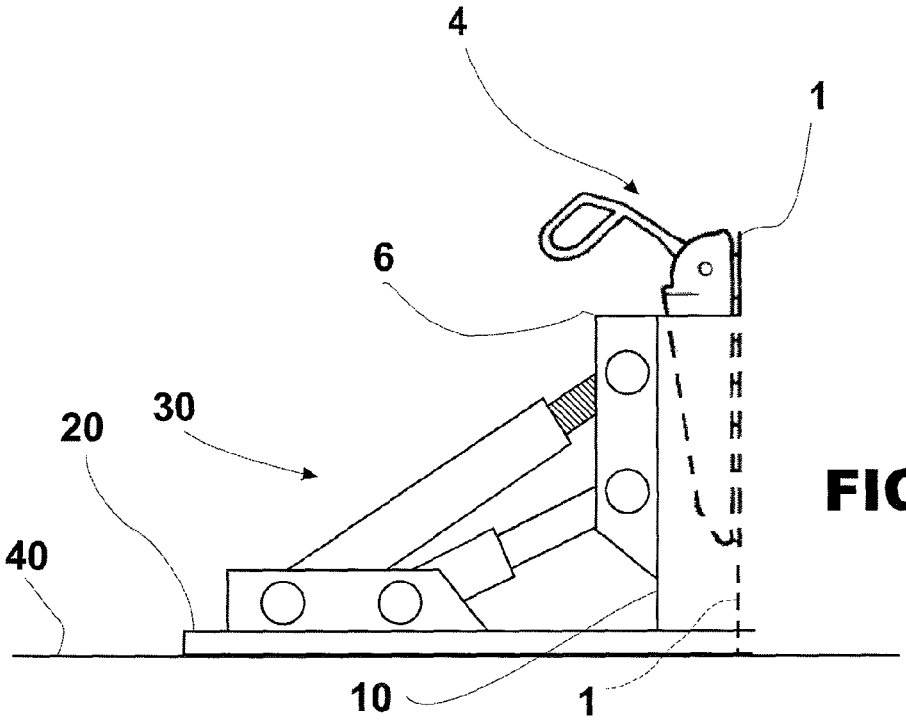
FIG. 4 is a partial side elevation view of the device with the holding structure attached to the casing, around a wedge (casing slips) device.
Figure 5:
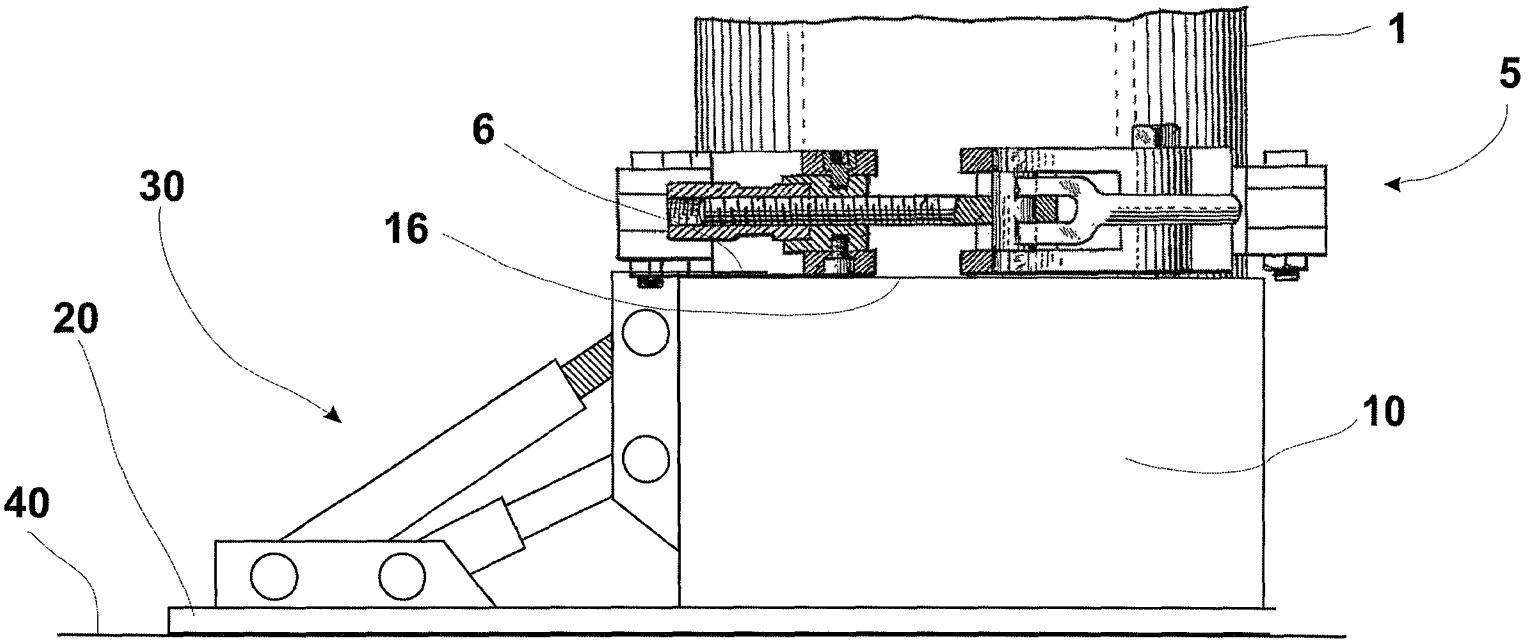
FIG. 5 is a partial side elevation view of the device with the holding structure attached to the casing between a holding collar device and the well head floor.

MAIN REFERENCES (1) Surface casing
(2) Well head (tubular application device)
(3) Upper part of head (2)
(4) Holding wedges or casing slips (tubular application device)
(5) Holding collar or safety collar (tubular application device)
(6) Lower contact part (with the upper edge (16))
(10) Holding structure
(11) Closure of structure (10)
(12) Hinge of structure (10)
(13) Upper bases or gussets
(14) First upper link
(15) Second upper link
(16) Upper contact edge (with lower contact part (6) of (4) (5) or (6))
(20) Support base
(21) Joint between base parts (20)
(22) Joining means at joint (21)
(23) Lower bases or gussets
(24) First lower link
(25) Second lower link
(30) Sets of adjustable support arms
(31) Positional regulation arms
(32) Hydraulic connectors
(33) Hydraulic hoses
(34) Hydraulic cylinders
(35) Positional fixing arms
(36) Threaded portion
(37) Fore and aft variation means and lock (nut and counter nut)
(40) Well head floor (normally upper wall of the cellar)

The temporary support device for oil well casing, installed on casing in the well cellar, may be applied to the upper end of a well surface casing (1), adjacent or butted up to a tubular application device such as a well head (2), a holding wedge device (casing slips)(4), a holding collar device (safety collar) (5) or an equivalent device, as a support for said tube (1) while operations are taking place and/or while cementation of the surrounding region is carried out and set, permanently fixing said casing (1).

The upper end of the casing (1) is the where tubular application devices (2), (4), (5) are normally arranged, above a floor (40) of the well cellar, said floor (40) being normally constituted by the upper wall of the well cellar.

A device constructed in accordance with the present invention can comprise a holding structure (10) to be mounted around the upper end of casing (1), a support base (20) capable of bearing weight on the the cellar (40) floor, adjustable support arms (30) engaging said base (20) to said holding structure (10), said arms (30) giving longitudinal and axial positional regulation of said casing (1).

DETAILED DESCRIPTION OF THE PREFERRED EMBODIMENTS

Generally, the present invention relates to a temporary support device for oil well tubes comprising a holding structure (10) to be applied to the surface casing (1), a weight-bearing support base (20) on the floor of the cellar (40) and sets of adjustable supporting arms (30) connecting said holding structures (10) to said supporting base (20).

More particularly, the device of the invention is mounted in the cellar of an oil or gas well and is attachable to the casing (1), at the upper end of which tubular application devices such as a well head (2), a holding wedge device (casing slips) (4), a holding collar device (safety collar) (5) or the like are normally arranged.

In the case of well head (2), the region for mounting the device of the invention is the mentioned upper end of surface casing (1), below the well head (2) and above the floor (40), this floor (40) being normally constituted by the upper wall of said well cellar.

The supporting base (20) is set on top of the cellar floor (40). This may be two or more main parts arranged around the upper end of the surface casing (1). In the present embodiment, the supporting base (20) comprises two main parts connected by joints (21) provided with joining means (22) such as, for example, bolt and nut sets.

Said supporting base (20) has lower bases (23) which have lower links (24, 25) allowing an articulated connection between said supporting base (20) and sets of adjustable support arms (30). Each set of adjustable support arms (30) comprise a positional regulation arm (31) and a positional fixing arm (35).

The positional regulation arm (31) may be hydraulic, mechanical or the like to accomplish the same effect. In the present embodiment, positional regulation arms (31) to are hydraulic and are comprised of hydraulic cylinders (34) having connectors (32) with hoses (33) connecting them to a hydraulic driving circuit.

Positional fixing arms (35) are arranged adjacent to the positional regulation arms (31). In this embodiment, they are above the positional regulation arms. Each positional fixing arm (35) allows longitudinal variation and locking means (37). In this case, said longitudinal variation means (37) are consists of a threaded portion (36) and a nut. The lock is assembled with a counter nut.

Further, the adjustable support arm sets (30) are connected to the holding structure (10) by upper links (14, 15) and in the present embodiment, are mounted on upper basements or gussets (13).

The holding structure (10) may be comprised one or more parts. In the present embodiment, it has two main parts surrounding the upper end of the surface casing (1). These two main parts are engaged, on one side by a hinge (12), and on the other they have a closure (11) which, for example, may be formed by two joint laps and a set of pins or the like.

Operation: Once the supporting base (20) is assembled and placed on the well's cellar floor (40), the holding structure (10) is mounted around the upper end of the casing (1), adjacent the tubular application device (2, 4, 5) already installed. More particularly, in the case of a well head (2), apart from surrounding the upper end of the tube (1), said holding structure (10) butts its upper edge (6) against the lower part (16) of said well head (2). In case of a holding wedge device (casing slips) (4), the holding structure (10) is arranged around said holding wedges (4) that are applied to the casing (1). In the case of a holding collar device (safety collar) (5), the holding structure (10) which is arranged below said holding collar (5), butts its upper edge (6) against the lower part (16) of said collar (5).

Prior to cementation, adjustable support arms (30) allow moving the holding structure (10) until the position in which the structure (10) is fixed on the tube (1) is reached. This is due to the fact that positional regulation arms (31), located at different angular positions around the tube (1), may be driven as a whole or independently by means of their hydraulic cylinders (34). This permits effecting the required movements. Once the desired position is reached, positional fixing arms (35) are extended and retracted until they are located in correspondence with said positional regulation arms (31). In this way, longitudinal variation and lock means (37) allow said positional fixing arms (35) to remain fixed, immobilizing and securing the device and, consequently, the surface casing (1). Thus, the casing (1) is supported by the device of the invention. This supporting action is temporary until the programmed operation is carried out, for example, installation of a well head (2) and/or cementation of the region surrounding casing (1) and supporting it until cement sets, permanently fixing the casing pipe (1).

Method: In particular embodiments, the method of the invention comprises a first step in which the supporting base (20) is placed on the well cellar floor (40). Then the holding structure (10) is mounted on the upper end of the casing (1). Further, hydraulic cylinders of the positional regulation arms (31) are driven until the desired position is reached. Then, positional fixing arms (35) are arranged and locked into place. The device is maintained under these conditions, at least during the necessary operative period of time (for installing a well head (2)) and/or until the cementation of casing (1) sets. Optionally, the device is disassembled and removed.

Having thus described a preferred embodiment of the invention and the way in which it could be put into practice, alternatives or modifications concerning certain construction and form details could be made without departing from the scope of the annexed claims.

What is claimed is:

1. A temporary support device for an oil well tube, to be installed at a well site, applied to the upper end of a well surface casing, adjacent to a tubular application device, the temporary support device comprising:

a holding structure to be mounted around the upper end of the tube;

a supporting base capable of being placed on a well cellar floor;

adjustable support arms that connect said supporting base to said holding structure, said adjustable support arm providing means of positional, longitudinal and axial regulation of said casing;

wherein there support arms provide for adjustable movement of the holding structure with respect to the supporting base after the holding structure is secured to an oil well tube;

wherein the adjustable support arms each comprise a set of arms, in which each set is made up of at least one positional regulation arm and at least one positional fixing arm; and wherein each positional fixing arm has threaded longitudinal variation nut and counter nut means for positional locking.

2. The temporary support device of claim 1 wherein the positional regulation arm and the positional fixing arm of each set are placed adjacent to each other.

3. The temporary support device of claim 2 wherein each positional regulation arm comprises corresponding hydraulic cylinders acting independently.

4. The temporary support device of claim 1, wherein the adjustable support arms are hydraulically-driven positional regulation arms.

5. The temporary support device of claim 1 wherein the holding structure comprises at least two hinged parts provided with closure means.

6. The temporary support device of claim 1 wherein the supporting base comprises at least two parts including connection means.

7. The temporary support device of claim 1 wherein the adjustable supporting arms and the base are connected by bolt and nut linkages.

8. The temporary support device of claim 1 wherein the adjustable supporting arms and the holding structure are connected by bolt and nut linkages.

9. The temporary support device of claim 8 wherein the linkages are detachable.

10. A method of using a temporary support device for an oil well tube comprising the steps of:

placing a supporting base on a well's cellar floor;

mounting a holding structure at an upper end of the tube;

adjusting positional regulation arms until a desired position for the holding structure is reached with respect to the supporting base;

securing said desired position by locking positional fixing arms;

maintaining active the temporary support device at least during a period of time for setting cementation of the tube; and wherein the step of securing said desired position by locking said positional fixing arms further comprises extending or retracting the positional fixing arms to correspond with movement of the holding structure with respect to the supporting base and locking the positional fixing arms against further extension or retraction with a threaded nut.

11. The method of claim 10 wherein the step of adjusting positional regulation arms comprises actuating one or more hydraulic cylinders to move the holding structure with respect to the supporting base.

* * * * *